US005332394A

United States Patent [19]

Frost

[11] Patent Number: 5,332,394

[45] Date of Patent: Jul. 26, 1994

[54] ELECTRICAL CONNECTOR FOR CONNECTING A VOLTAGE SOURCE TO A SPARK PLUG TERMINAL

[75] Inventor: Edwin L. Frost, Tequesta, Fla.

[73] Assignee: The BG Service Co., Inc., West Palm Beach, Fla.

[21] Appl. No.: 133,931

[22] Filed: Oct. 12, 1993

[51] Int. Cl.[5] ..... H01R 13/18

[52] U.S. Cl. ..... 439/125; 439/846

[58] Field of Search ..... 439/125-128, 439/818, 843, 846, 847

[56] References Cited

U.S. PATENT DOCUMENTS

| | | | |
|---|---|---|---|
| 1,509,224 | 9/1924 | Berthold | 439/430 |
| 1,792,866 | 2/1931 | Rabezzaner | 439/846 |
| 1,835,000 | 12/1931 | Berthold | 439/848 |
| 1,911,395 | 5/1933 | Rowley | 439/263 |
| 2,666,423 | 1/1954 | Johnson, Jr. | 439/125 |
| 3,223,963 | 12/1965 | Ravey et al. | 439/847 |
| 3,359,526 | 12/1967 | Bakker | 439/125 |
| 3,431,534 | 3/1969 | Schrader et al. | 439/125 |
| 3,435,404 | 3/1969 | Kato | 439/125 |
| 4,145,106 | 3/1979 | Livingston | 439/126 |
| 4,621,881 | 11/1986 | Johansson et al. | 439/125 |
| 4,886,473 | 12/1989 | Germ | 439/847 |
| 4,997,380 | 3/1991 | Etienne et al. | 439/127 |
| 5,127,840 | 7/1992 | Bezusko et al. | 439/127 |

*Primary Examiner*—Gary F. Paumen

[57] ABSTRACT

An electrical connector for connecting a high voltage source to a spark plug terminal. The connector is comprised of a conductive terminal insert which houses a volute spring and provides for improved electrical contact by applying axial spring pressure on the spark plug terminal when installed. A spring clip with dimples is located in a radial exterior groove of the terminal insert. The dimples fit through thruholes in the groove wall applying radial force to the spark plug terminal thereby mechanically securing the connector. The connector also includes a means of connection to a high voltage source and an insulator.

2 Claims, 2 Drawing Sheets

ELECTRICAL CONNECTOR FOR CONNECTING A VOLTAGE SOURCE TO A SPARK PLUG TERMINAL

BACKGROUND FIELD OF THE INVENTION

This invention relates generally to electrical connectors and more specifically to connectors for attaching ignition leads to the spark plug terminals of internal combustion engines.

BACKGROUND—DESCRIPTION OF PRIOR ART

Many varying types of connectors have been proposed and used for making electrical connection from an ignition cable to a spark plug. For many applications, including most automotive applications, the existing art solves the problem. However, for many severe service applications, including large stationary industrial engines and certain high compression vehicular engines, the problem remains unsolved, as shall be explained forthwith. U.S. Pat. No. 1,835,000 (Berthold, 1931) and U.S. Pat. No. 3,359,526 (Bakker, 1967) show typical automotive type connectors in which the electrical connection to the spark plug is by means of a single metallic sleeve inserted onto a spark plug terminal. While inexpensive to manufacture, the clamping force of these sleeves diminishes over time as metal relaxes and deforms due to vibration and heat. Large stationary industrial engines produce considerably greater vibrations and higher temperatures than conventional automotive engines. This is exacerabated by the fact that industrial engines often run continuously. An automobile with a useful life of 100,000 miles equates to a total operating life of 2500 hours (at 40 MPH). A stationary industrial engine operating a compressor on a natural gas pipeline will operate 8,760 hours in only one year, operating 24 hours a day. Another drawback to this type of connector is that the clamping force is effected by the design and tolerances of the spark plug terminal or nut. For the reasons stated herein, the above types of connectors are rarely used on the larger stationary industrial engines.

Prior art exhibit "A" shows the type of connector typically used on large stationary industrial engines and in certain automotive applications. The clip and ferrule design is disclosed in U.S. Pat. No. 1,509,224 (Berthold, 1924).

This design is deficient in 3 respects.

1. Clip and ferrule are attached by means of a rivit or stake. Clip and ferrule frequently loosen and come apart due to vibration causing premature ignition failure.

2. The clip and ferrule design is frequently incorporated into an insulative spark plug boot. The ends of clip have sharp corners which protrude outward through the ferrule slots when engaged on the spark plug terminal or nut. The corona effect which occurs at high voltage concentrates in the area of these sharp corners which are in close proximity to the boot insulator material, ultimately breaking down the insulator boot material and causing premature ignition failure. This failure mode has become more prevalent with the advent of so called "clean burn" engines required to meet governmental pollution standards. These engines operate at higher temperatures and require higher voltages to ignite the combustible mixture. In many of these applications the spark plug can only contain the voltage with the aid of a tight fitting boot covering the spark plug insulator, so it is essential that the integrity of the insulative material be maintained.

3. While initial clamping pressure is somewhat increased relative to the single sleeve design, the clip fingers tend to relax under the effects of prolonged exposure to heat and vibration, yielding a less than optimum electrical contact. This problem is more of a concern now than in the past because the heat is much more intense in the spark plug well as the result of clean burn engine technology.

U.S. Pat. No. 4,997,380 (Etienne et al, 1991) discloses a spark plug connector for roved radial clamping of the spark plug terminal, however, the device relies on use of flexible insulating material to achieve the end result. Rigid materials with greater dielectric strength such as teflon and ceramic are preferred in industrial applications because of the higher temperatures associated with these applications. Additionally, this connector is considerably more costly to manufacture than those currently used in industrial engine applications.

U.S. Pat. No. 1,911,395 (Rowley, 1933) reveals a locking connector for improved electrical and mechanical contact. This design requires connection to a male ball type terminal. Spark plugs in current manufacture for industrial engines do not have this type of terminal so the device does not solve the problem.

Similarly, U.S. Pat. No. 5,127,840 (Bezusko et al, 1992) discloses a connector for a spark plug with a recessed female terminal. Spark plugs of this type are not available for industrial applications, so again, this connector does not solve the problem.

It will be readily apparent to one skilled in the art that stationary industrial engines and certain automotive engines pose unique problems resulting from greater vibration, greater heat, higher voltages, and longer continuous running times associated with these applications. Likewise, the consequences of ignition failure are greater: costly engine downtime results in lost production time which can translate into thousands of dollars per hour. It is readily apparent that all of the spark plug connectors heretofore known fail to satisfy requirements of these engines, and further more, as a result of on-going advances in clean burn technology, the engine environment is becoming more hostile, rendering existing connectors inappropriate for use in these applications. The disadvantages of these connectors are summarized as follows.

(a) Radial clamping force (electrical contact) diminishes over time as the result of vibration and high heat.

(b) Clip & ferrule joint (rivet, stake, etc) loosen due to vibration. Clip & ferrule comes apart.

(c) Corona discharge is concentrated at the sharp corners of the clip ends degrading the insulative material of the spark plug boot.

(d) Radial clamping force adversely-effected by design variations and tolerances of various spark plug terminals.

(e) Designs requiring use of flexible insulating material to enhance radial clamping preclude the use of higher dielectric insulating material such as teflon and ceramic.

(f) Designs requiring use of a special spark plug and spark plug terminals cannot be used on standard industrial spark plugs.

OBJECTS AND ADVANTAGES

Accordingly, several objects and advantages of my invention are:

(a) To provide a connector whose electrical contact will not diminish adversely over time as the result of vibration and high heat. (b) To provide a connector which is mechanically unaffected by the effects of long term vibration and high heat.

(c) To provide a connector designed to minimize concentrations of corona that adversely affect insulating materials.

(d) To provide a connector that can tolerate a wider variation in spark plug terminal designs and tolerances without effecting electrical and mechanical contact.

(e) To provide a single connector that can be used with virtually any commonly used automotive or industrial spark plug terminal.

(f) To provide a connector that can be used in conjunction with spark plug boots made of virtually any insulating material appropriate to the application.

Further objects and advantages are that my invention is suitable for a wide variety of embodiments including insulated spark plug extensions. Furthermore, my invention contemplates executions of the invention to permit connection to high voltage cables by whatever means may be desired, for example, threaded stud, bayonette, weld, braze, etc.

DRAWING FIGURES

REFERENCE NUMERALS IN THE DRAWINGS

Figure 1:
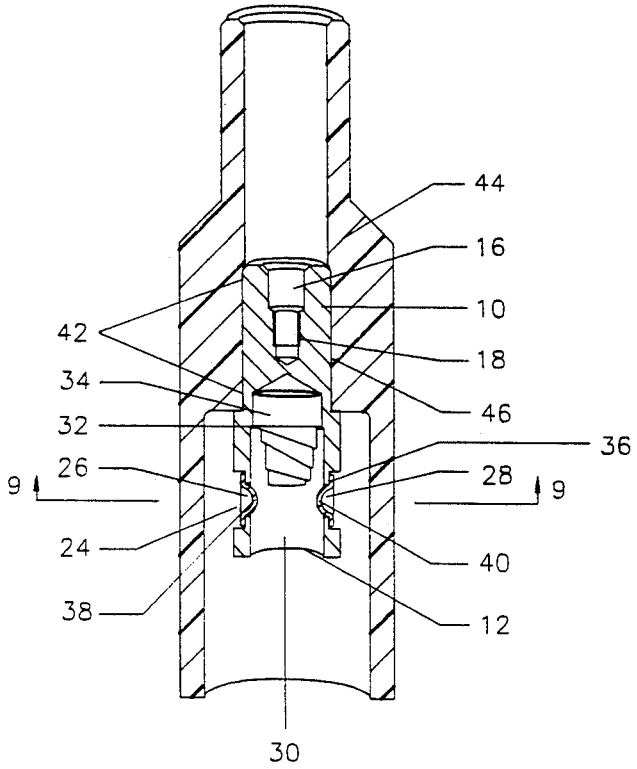
FIG. 1 shows a longitudinal sectional view of the connector, embodied in a teflon spark plug boot, and with threaded stud hole as a means of connection.

10: terminal insert
12: end
14: spark plug terminal
16: stepped hole
18: threaded area
20: stud
22: stud upper area
24: groove
26: thruhole
28: thruhole
30: hole
32: step
34: volute spring
36: spring clip
38: dimple
40: dimple
42: upper end
44: insulator
46: hole
48: bayonet
50: cable
52: terminal receptacle
54: stud
56: wire conductor
58: spark plug
60: area
62: convex surface
64: concave surface

DESCRIPTION OF THE INVENTION

Figure 2:
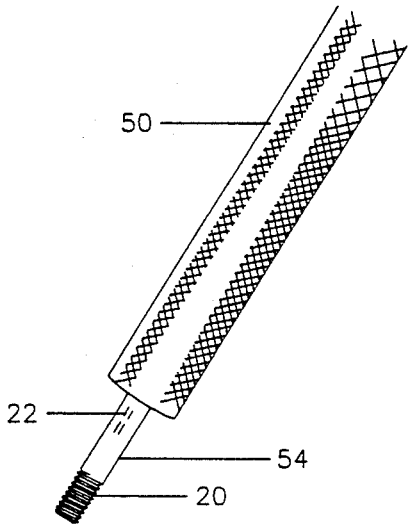
FIG. 2 shows a high voltage cable with a threaded stud crimped to the conductor.
Figure 3:
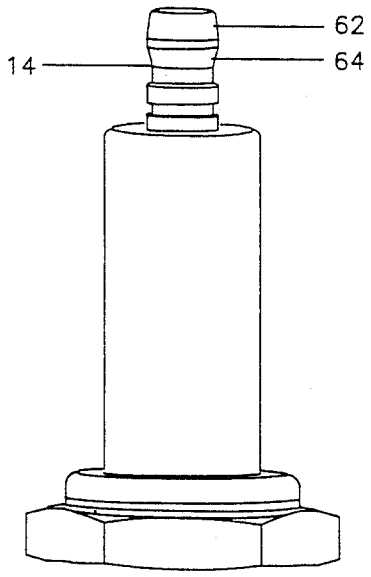
FIG. 3 shows a spark plug terminal and upper portion of the spark plug.
Figure 4:
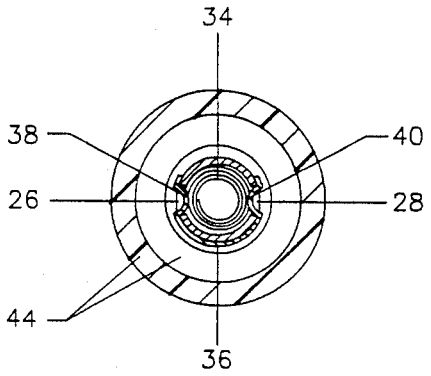
FIG. 4 shows a transverse sectional view taken on line 9—9 of FIG. 1.

FIG. 1 is a typical embodiment of the invention. A terminal insert or terminal body 10 is open at end 12 to fit over a spark plug terminal 14 (shown in FIG. 3). At the opposite end of terminal insert 10 is a means of connection, which in this embodiment is a stepped hole 16, with a threaded lower area 18 of reduced diameter which is of such size and dimension as to mate with the threads on a metallic stud 20 (shown in FIG. 2). The enlarged unthreaded upper part of stepped hole 16 is of adequate diameter that when stud 20 is crimped at an upper area 22, the resulting deformation will fit within the confines of the hole. Terminal insert 10 has a lateral groove 24, with a thruhole 26 and a thruhole 28. Thruholes 26 and 28 are centered latitudinally in the groove and at opposite sides as best shown in FIG. 4. Open end 12 of terminal insert 10 is a hole 30 of adequate diameter to fit over spark plug terminal 14. The diameter of hole 30 is reduced at step 32 to a diameter which is slightly less than the diameter of largest coil of a volute spring 34, allowing volute spring 34 to be press fit into the resultant cavity and be secured therein.

This invention contemplates that in other embodiments volute springs of varying sizes may be used, in which case a reduced diameter at step 32 may not be required and, in fact, an outward step at 32 resulting in an increased diameter may be required. While volute spring 34 may be made of any conductive material and have a variable number of coils, it has been found that volute springs made from inconel (then heat treated) and having $4\frac{1}{4}$ coils provide excellent spring pressure and durability.

A spring clip 36, best shown in FIG. 4, has a dimple 38 and a dimple 40 which protrude in an inward manner in the direction of spring clip axis. Dimples 38 and 40 are located at a slightly obtuse angle relative at one another in such manner that when spring clip 36 is inserted into groove 24, the resulting spring clip expansion will place dimple 38 at a 180° angle to dimple 40. The size of the inside diameter of spring clip 36 is such that it will fit tightly into groove 24. Spring clip 36 is positioned radially in groove 24 in such a manner the dimples 38 and 40 protrude into thruholes 26 and 28 of terminal insert 10. The size and shape of the dimples is such that they protrude fully through thruholes 26 and 28 and into hole 30 for a distance sufficient to retain spark plug terminal 14 (shown in FIG. 3). Spring clip 36 may be made of any resilient material, however, a hard and relatively stiff spring material has been found to work best. Although the embodiment described herein provides for two thruholes (26 & 28) and two dimples (38 & 40), additional thruholes and dimples may be used at variable locations.

Terminal insert 10 is made from brass or other suitably conductive material. In the embodiment shown in FIG. 1, the exterior surface of terminal insert 10 at an upper end 42 is knurled for the purpose of securing terminal insert 10 into teflon insulator 44. The outside diameter at 42 is such that terminal insert 10 may be press fit into hole 46 of insulator 44 and will become securely fixed in its position.

Figure 6:
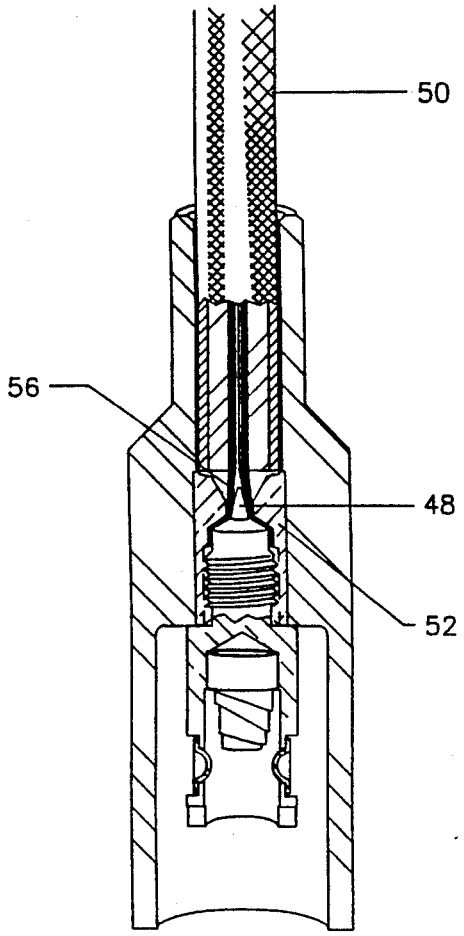
FIG. 6 shows a longitudinal sectional view of the connector with a bayonet as means of connection, embodied in a teflon insulator with separate metallic insert.
Figure 5:
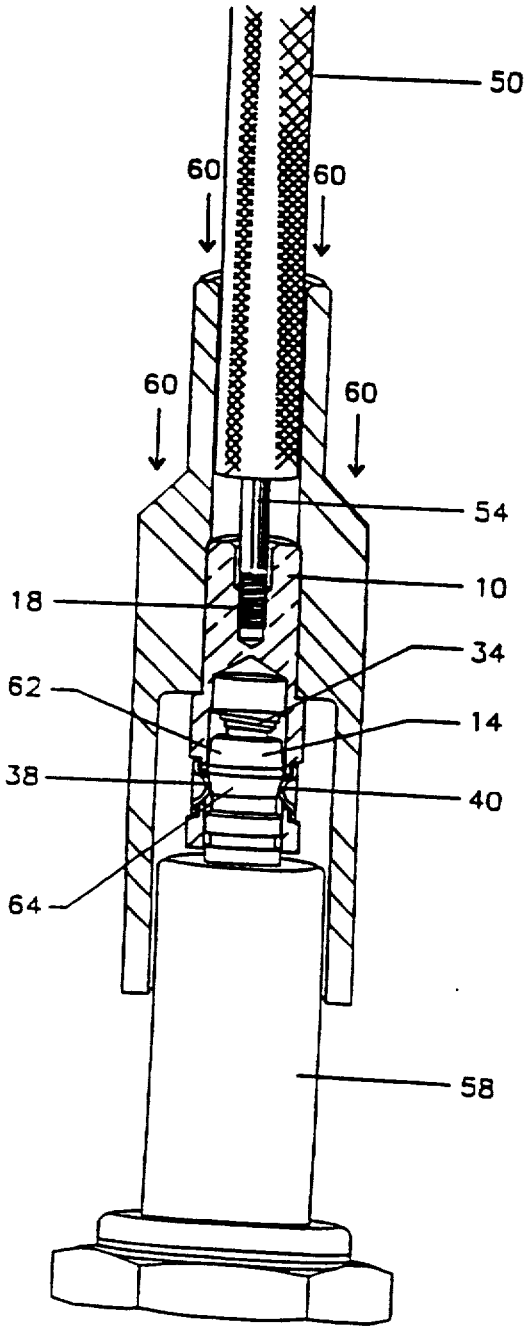
Figure 6:
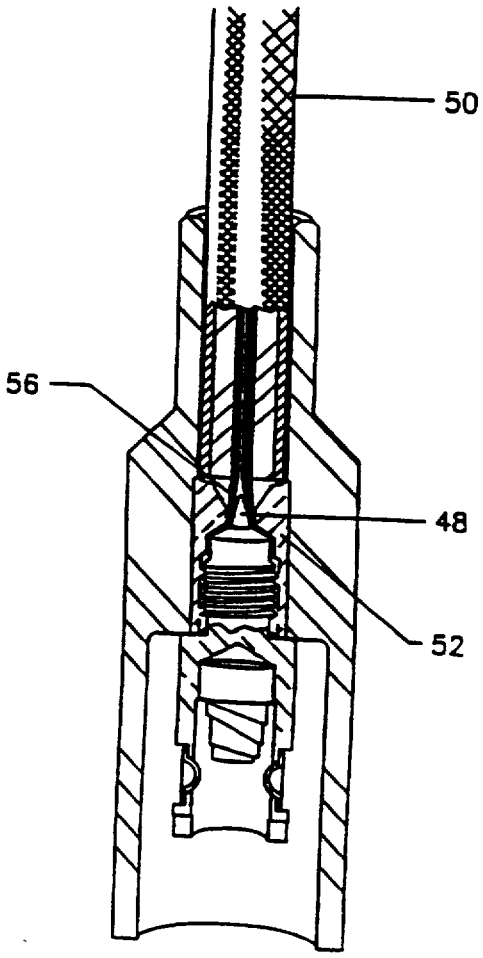

While FIG. 1 shows a teflon insulator 44, the scope of my improved connector includes embodiments using other insulative materials. While FIG. 1 shows a threaded area 18 for connection to threaded stud 20, my improved terminal in other embodiments allows for electrical connection to cable 50 by numerous means known to those skilled in the art. For example, an embodiment of my invention using a bayonet 48 and separated terminal receptacle 52 are shown in FIG. 6. Hence the size, shape, internal and external geometry of upper end 42 of terminal insert 10 is variable and separable, being dependent on the insulator used and means of connection. Likewise, there are many ways of affixing an insulator to the terminal insert as will be evident to those skilled in the art. For example, instead of knurled surface area, an epoxy or ceramic to metal seal might be employed.

OPERATION

Figure 5:
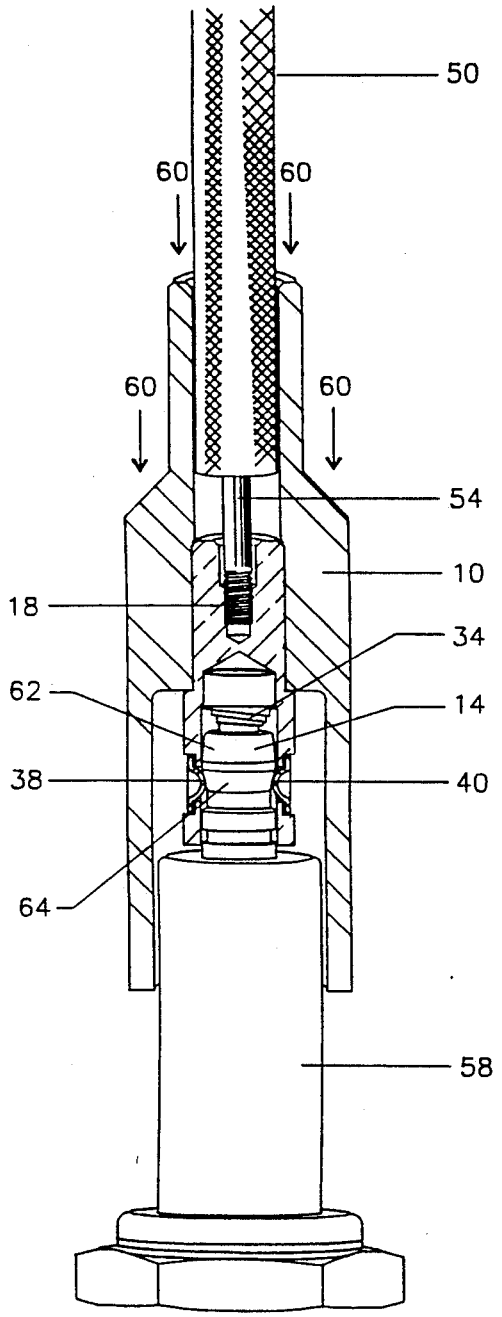
FIG. 5 shows a longitudinal sectional view of the connector with cable and spark plug assembled.

The manner of using my improved terminal is identical to that for terminals currently used. The cable conductor is attached to terminal in the normal way by whatever means. In FIG. 5 this is illustrated where stud 54 is screwed into terminal insert 10 at threaded area 18. In FIG. 6 this is illustrated where conductor wires 56 are flared and clamped between bayonet 48 and receptacle 52.

FIG. 5 shows my improved terminal installed on spark plug 58. This is accomplished by applying axial force at 60. As the connector moves downward over the spark plug terminal 14, volute spring 34 collapses. At the same time dimples 38 and 40 collapse as they travel over convex surface 62 of spark plug terminal 14. As dimples 38 and 40 pass over concave surface 64 (best viewed in FIG. 3) they then return to their original uncollapsed positions. The volute spring 34 provides downward thrust forcing dimples 38 and 40 to come to rest on concave surface 64. Despite the significant spring pressure generated by volute spring 34, the lateral spring pressure generated by spring clip 36 is sufficient to maintain the grip of dimples 38 and 40 on the terminal 14.

SUMMARY, RAMIFICATIONS, AND SCOPE

Accordingly, the reader will readily see that my improved connector provides electrical contact that will not diminish adversely over time as the result of vibration and heat. Likewise, the connector is mechanically unaffected by vibration and heat. There are no sharp protrusions external to the terminal insert and therefore there is no degradation of insulative materials due to corona concentrations. My connector tolerates a wide variation of spark plug terminal designs and may be used with virtually any commonly used automotive or industrial spark plug. Furthermore, this connector may be used in conjunction with virtually any insulative material appropriate to the application. My improved connector is as easy to install and remove as conventional connectors. While the cost to manufacture my connector is slightly more than connectors now used, my improved connector is expected to save thousands of dollars in reduced downtime in severe service industrial applications.

While my above description contains many specificities, they should not be construed as limitations on the scope of the invention, but rather exemplifications of preferred embodiments. Many variations are possible. For example, my connector could be incorporated into a telescoping extension which makes direct connection into a coil mounted in the cylinder head. In this case, no cabling would be required.

I claim:

1. An electrical connector for mechanically and electrically connecting a voltage source to a spark plug terminal, comprising:

(a) a conducting part having a first end suitable for receiving a voltage source and a second end suitable for connecting to said spark plug terminal; said second end comprising a hole creating a cavity to receive the spark plug terminal and a plurality of lateral thruholes, (b) a spring located in said hole whereby axial spring pressure is applied against the spark plug terminal end providing improved electrical contact, (c) a means of applying lateral spring pressure through said plurality of lateral thruholes; said lateral spring pressure being applied to the sides of the spark plug terminal whereby said electrical connector becomes mechanically secured to the spark plug terminal when applied thereto, (d) an insulating sleeve of variable shape and composition; said insulating sleeve wholly or partially surrounding said conducting part, (e) a means of securing the conducting part to said insulating sleeve.

2. The electrical connector of claim 1 wherein said conducting part has a lateral groove on the exterior surface with a plurality of thruholes; wherein said means of applying lateral spring pressure is a spring clip having a plurality of dimples; said spring clip being positioned in said lateral groove in such a manner that said dimples align and pass through said thruholes, whereby said electrical connector becomes mechanically secured to the spark plug terminal when applied.

* * * * *

UNITED STATES PATENT AND TRADEMARK OFFICE

CERTIFICATE OF CORRECTION

PATENT NO. : 5,332,394

DATED : July 26, 1994

INVENTOR(S) : Edwin L. Frost

It is certified that error appears in the above-indentified patent and that said Letters Patent is hereby corrected as shown below:

Col. 2, line 12, change "roved" to --improved--.

Signed and Sealed this

Eighteenth Day of October, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,332,394

DATED : July 26, 1994

INVENTOR(S) : Edwin L. Frost

It is certified that error appears in the above-indentified patent and that said Letters Patent is hereby corrected as shown below:

The title page should be deleted and substitute therefor the attached title page.

Delete Drawing Sheet 2 and substitute therefor the Drawing Sheet consisting of FIGS. 5-6, as shown on the attached page.

Signed and Sealed this

Twenty-seventh Day of December, 1994

*Attest:*

Bruce Lehman

BRUCE LEHMAN

*Attesting Officer*

*Commissioner of Patents and Trademarks*

United States Patent [19]

Frost

[11] Patent Number: 5,332,3

[45] Date of Patent: Jul. 26, 19

[54] ELECTRICAL CONNECTOR FOR CONNECTING A VOLTAGE SOURCE TO A SPARK PLUG TERMINAL

[75] Inventor: Edwin L. Frost, Tequesta, Fla.

[73] Assignee: The BG Service Co., Inc., West Palm Beach, Fla.

[21] Appl. No.: 133,931

[22] Filed: Oct. 12, 1993

[51] Int. Cl.[5] ..... H01R 13/18

[52] U.S. Cl. ..... 439/125; 439/846

[58] Field of Search ..... 439/125–128, 439/818, 843, 846, 847

[56] References Cited

U.S. PATENT DOCUMENTS

| | | | |
|---|---|---|---|
| 1,509,224 | 9/1924 | Berthold | 439/430 |
| 1,792,866 | 2/1931 | Rabezzaner | 439/846 |
| 1,835,000 | 12/1931 | Berthold | 439/848 |
| 1,911,395 | 5/1933 | Rowley | 439/263 |
| 2,666,423 | 1/1954 | Johnson, Jr. | 439/125 |
| 3,223,963 | 12/1965 | Ravey et al. | 439/847 |
| 3,359,526 | 12/1967 | Bakker | 439/125 |
| 3,431,534 | 3/1969 | Schrader et al. | 439/1 |
| 3,435,404 | 3/1969 | Kato | 439/1 |
| 4,145,106 | 3/1979 | Livingston | 439/1 |
| 4,621,881 | 11/1986 | Johansson et al. | 439/1 |
| 4,886,473 | 12/1989 | Germ | 439/8 |
| 4,997,380 | 3/1991 | Etienne et al. | 439/1 |
| 5,127,840 | 7/1992 | Bezusko et al. | 439/1 |

*Primary Examiner*—Gary F. Paumen

[57] ABSTRACT

An electrical connector for connecting a high voltag source to a spark plug terminal. The connector is com prised of a conductive terminal insert which houses volute spring and provides for improved electrica contact by applying axial spring pressure on the sparl plug terminal when installed. A spring clip with dimple is located in a radial exterior groove of the termina insert. The dimples fit through thruholes in the groove wall applying radial force to the spark plug termina thereby mechanically securing the connector. The con- nector also includes a means of connection to a high voltage source and an insulator.

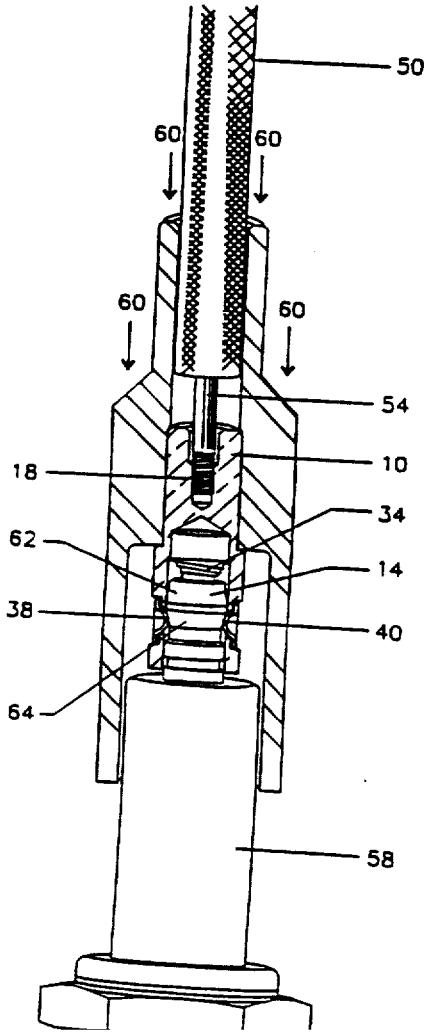

2 Claims, 2 Drawing Sheets